US008098013B2

(12) United States Patent
Uemura et al.

(10) Patent No.: US 8,098,013 B2
(45) Date of Patent: Jan. 17, 2012

(54) PLASMA DISPLAY PANEL AND DISPLAY DEVICE USING THE SAME

(75) Inventors: Norihiro Uemura, Hitachinaka (JP); Shunichiro Nobuki, Tachikawa (JP); Naoya Tokoo, Mito (JP); Masakazu Sagawa, Inagi (JP)

(73) Assignee: Hitachi Consumer Electronics Co., Ltd., Tokyo (JP)

( * ) Notice: Subject to any disclaimer, the term of this patent is extended or adjusted under 35 U.S.C. 154(b) by 165 days.

(21) Appl. No.: 12/502,552

(22) Filed: Jul. 14, 2009

(65) Prior Publication Data

US 2010/0013370 A1 Jan. 21, 2010

(30) Foreign Application Priority Data

Jul. 15, 2008 (JP) ..... 2008-183956

(51) Int. Cl.
*H01J 17/49* (2006.01)

(52) U.S. Cl. ..... 313/582; 315/169.4; 345/60

(58) Field of Classification Search ..... None
See application file for complete search history.

(56) References Cited

U.S. PATENT DOCUMENTS

| | | | | |
|---|---|---|---|---|
| 2005/0206318 | A1 | 9/2005 | Hirota et al. | |
| 2008/0203893 | A1 * | 8/2008 | Sakai et al. | 313/486 |
| 2009/0200945 | A1 * | 8/2009 | Okuyama et al. | 313/643 |

FOREIGN PATENT DOCUMENTS

| | | | |
|---|---|---|---|
| JP | 11-35372 | A | 2/1999 |
| JP | 11-86735 | A | 3/1999 |
| JP | 2000-169841 | A | 6/2000 |
| JP | 2004-207047 | A | 7/2004 |
| JP | 2005-276447 | * | 10/2005 |
| JP | 2005-276447 | A | 10/2005 |
| JP | 2006-59786 | A | 3/2006 |
| JP | 2007-317613 | A | 12/2007 |
| JP | 2008-66176 | A | 3/2008 |

* cited by examiner

*Primary Examiner* — Ashok Patel
(74) *Attorney, Agent, or Firm* — Mattingly & Malur, PC

(57) ABSTRACT

A plasma display device includes: a front substrate and a back substrate facing each other and interposing a discharge gap; and a plurality of discharge cells formed by the front substrate and the back substrate, wherein a mixture gas containing Xe is filled in the discharge gap, and a red, green, or blue phosphor materials is arranged in each of the discharge cells. The plasma display device performs a reset operation by, at least, a weak discharge. A crystal material is arranged in the red, green, and blue phosphor materials so as to make weak discharge firing voltages for reset discharges in respective discharge cells uniform.

17 Claims, 10 Drawing Sheets

PLASMA DISPLAY PANEL AND DISPLAY DEVICE USING THE SAME

CROSS-REFERENCE TO RELATED APPLICATION

The present application claims priority from Japanese Patent Application No. JP 2008-183956 filed on Jul. 15, 2008, the content of which is hereby incorporated by reference into this application.

TECHNICAL FIELD OF THE INVENTION

The present invention relates to a plasma display panel (also called PDP and plasma panel). More particularly, the present invention relates to a plasma display device including a driving power supply and a panel structure which can achieve a plasma display panel in which a dark-room contrast thereof is improved and which has high image quality by reducing the luminance of a black display.

BACKGROUND OF THE INVENTION

In recent years, a plasma display device provided with a plasma display panel (hereinafter, called PDP) has been used as a color display device which is large and thin. A PDP is categorized into a direct-current (DC) type and an alternating-current (AC) type by differences in structures of the PDP and driving methods thereof. More particularly, an alternating-current surface discharge type PDP is a most-advanced method in practical use because of its simple structure and high reliability, and the PDP has a structure in which a sustain discharge electrode pair (X electrode and Y electrode which are paired) for generating a display discharge is arranged in parallel on a front substrate, an address electrode (A electrode) is arranged on a back substrate so as to intersect with the pair, and a plurality of discharge cells are arranged in a matrix.

There is ADS (Address Display-Period Separation) as a general grayscale display method of an image of a PDP. In the ADS method, one field (16.67 ms) is divided into a plurality of subfields each having a predetermined luminance ratio, and subfield light emission is selectively performed in these subfields depending on images, so that the grayscale is expressed by the luminance difference. Further, the subfield is configured with a reset period, an address discharge period, and a sustain discharge period. In the reset period, for substantially uniform wall voltages in all of the matrix-arranged discharge cells, a voltage of a firing voltage or larger is applied between the sustain discharge electrode pair to perform a reset discharge in all of the discharge cells. In the address discharge period, an address discharge for generating wall charges of a proper amount is performed only to discharge cells to be lighted among all of the discharge cells. In the sustain discharge period, a sustain discharge is performed depending on grayscale values of display data by using the wall charges.

Note that, as the present inventors have done a prior art search based on the invention results, the following patent documents have been extracted.

Japanese Patent Application Laid-Open Publication No. 2005-276447 (Patent Document 1) discloses a technique of reducing occurrence of address errors at the time of panel driving by forming a film containing a fluoride of alkaline metal or alkaline earth metal on a surface of a phosphor layer to make electric-charge characteristics uniform on the phosphor layer surface.

Also, Japanese Patent Application Laid-Open Publication No. H11-086735 (Patent Document 2) discloses a technique of reducing an address voltage by forming a layer formed of aluminum oxide, magnesium oxide, barium oxide, and zinc oxide on a surface of a phosphor to make the polarity of the phosphor positive.

Further, Japanese Patent Application Laid-Open Publication No. 2006-059786 (Patent Document 3) discloses a technique of improving a discharge delay characteristic and a luminance characteristic by forming a magnesium oxide layer containing a magnesium oxide crystalline body on a portion, at least, facing discharge cells of a front substrate and a back substrate to cause PL emission of the crystalline body.

Still further, Japanese Patent Application Laid-Open Publication No. 2008-066176 (Patent Document 4) discloses a technique of preventing a reduction of dark-room contrast caused by a reset discharge by mixing magnesium oxide into a phosphor layer.

SUMMARY OF THE INVENTION

The display performance of a PDP has been significantly improved, and a performance close to that of the cathode-ray tube has been obtained also in luminance, definition, contrast, and the like. In achievement of high contrast of a PDP, particularly, for improving the dark-room contrast, a further reduction of luminance at black display is desired. For improving the dark-room contrast, it is described that the reduction of luminance (minimum luminance) at black display is effective.

Meanwhile, a sufficient reset discharge is required for addressing many display lines in high speed in the address discharge period, and therefore, luminance (minimum luminance) of a certain degree is present. Accordingly, it is considered that stable operation and dark-room contrast are in a contrary relationship to each other.

As techniques disclosed in Patent Documents 1 to 4, by forming layers of metal fluoride and metal oxide on the phosphor layer surface or mixing magnesium oxide crystal into the portion facing the discharge cell and the phosphor layer, it is considered that the reset voltage causing the reset discharge can be reduced and the luminance at black display can be reduced to a certain degree. However, reduction of the reset voltage has limitations in the significant reduction of the minimum luminance.

The present inventors have newly found out the following problems. In the reset discharge, for making wall voltages in all of the discharge cells substantially uniform, a voltage of a firing voltage for the sustain discharge or larger is applied between the sustain discharge electrode pair, and this is performed in all of the discharge cells. The firing voltage for the reset discharge (weak discharge firing voltage) of each discharge cell is different depending on a phosphor material of each color provided in each discharge cell, and, for example, a weak discharge firing voltage of a phosphor material for red light emission is lower than that of a phosphor material for green light emission. Therefore, for resetting all of the discharge cells, the voltage has to be raised up to resetting a discharge cell of a color (for example, green) having a highest weak discharge firing voltage. Accordingly, a discharge cell of a color (for example, red) having a lower weak discharge firing voltage has to be excessively discharged, and therefore, luminance (minimum luminance) due to unnecessary light emission is caused.

An object of the present invention is to provide a technique capable of improving dark-room contrast of a PDP.

Another object of the present invention is to provide a technique capable of reducing minimum luminance of a PDP.

The above and other objects and novel characteristics of the present invention will be apparent from the description of the present specification and the accompanying drawings.

The typical ones of the inventions disclosed in the present application will be briefly described as follows.

(1) A plasma display device includes a plasma display panel having: a first substrate having a plurality of first electrode pairs extending in a first direction; a second substrate having a plurality of second electrodes extending in a second direction intersecting with the first direction, the second substrate facing the first substrate; and a plurality of discharge cells provided on each of positions at which the plurality of first electrode pairs and the plurality of second electrodes are intersected, wherein each of the plurality of discharge cells includes: a discharge gap provided between the first substrate and the second substrate facing the first substrate and surrounded by barrier ribs on the second substrate; a discharge gas containing Xe for filling the discharge gap; and a phosphor layer provided on the second substrate so as to contact with the discharge gap for emitting light of any one of red, blue, and green, and a voltage is supplied to the plurality of first electrode pairs to make firing voltages uniform for reset discharges to be caused in the plurality of discharge cells.

(2) In the item (1), crystal materials having different concentrations are arranged in the phosphor layers of red, blue, and green, respectively, so as to make the firing voltages uniform for the reset discharges caused in the plurality of discharge cells.

(3) In the item (2), the crystal material is arranged on, at least, a surface of the phosphor layer.

(4) In the item (2), the crystal material is arranged with being mixed with a material forming the phosphor layer.

(5) In the item (2), the crystal material is formed of, at least, any one of alkaline metal oxide, alkaline earth metal oxide, alkaline metal fluoride, and alkaline earth metal fluoride.

(6) In the item (5), the crystal material is formed of, at least, magnesium oxide.

(7) In any one of the items (4) to (6), the crystal material is set to 30 weight % or less of a weight ratio including the phosphor layer.

(8) In any one of the items (1) to (7), Xe concentration of the discharge gas is set to 8% or more.

(9) A plasma display panel includes a plurality of discharge cells having: a discharge gap provided between a first substrate and a second substrate facing the first substrate and surrounded by a barrier rib provided on the second substrate; a discharge gas containing Xe for filling the discharge gap; and a phosphor layer for emitting light of any one of red, blue, and green provided on the second substrate so as to contact with the discharge gap, wherein the phosphor layer includes any one of a first, a second, and a third phosphor material and a crystal material having a secondary electron emission coefficient larger than those of the phosphor materials, the secondary electron emission coefficient of the first phosphor material is larger than that of the second phosphor material, the secondary electron emission coefficient of the second phosphor material is larger than that of the third phosphor material, the crystal material is contained in the phosphor layer containing the second phosphor material more than the phosphor layer containing the first phosphor material, and the crystal material is contained in the phosphor layer containing the third phosphor material more than the phosphor layer containing the second phosphor material.

(10) In the item (9), the crystal material is formed of alkaline metal oxide, alkaline earth metal oxide, alkaline metal fluoride, or alkaline earth metal fluoride.

(11) In the item (10), the crystal material is formed of magnesium oxide.

The effects obtained by typical aspects of the present invention disclosed in the present application will be briefly described below.

According to one embodiment, the dark-room contrast of a PDP can be improved. Also, the minimum luminance of the PDP can be reduced.

BRIEF DESCRIPTIONS OF THE DRAWINGS

DESCRIPTIONS OF THE PREFERRED EMBODIMENTS

Hereinafter, embodiments of the present invention will be described in detail with reference to the accompanying drawings. Note that components having the same function are denoted by the same reference symbols throughout the drawings for describing the embodiment, and the repetitive description thereof will be omitted. Also, as for a front substrate (first substrate) and a back substrate (second substrate) which are a substrate pair configuring a PDP in the present application, the description will be made such that, when both substrates are assembled to make a panel, one substrate to be a display surface passing light emission of phosphors is the front substrate, and the other substrate not to be the display surface is the back substrate.

First Embodiment

Such a case is described that the present embodiment is applied to a PDP of 50 inch full HD (1920×1080 pixels). In this case, a cell pitch thereof is 580 μm long and 192 μm wide.

Figure 1:
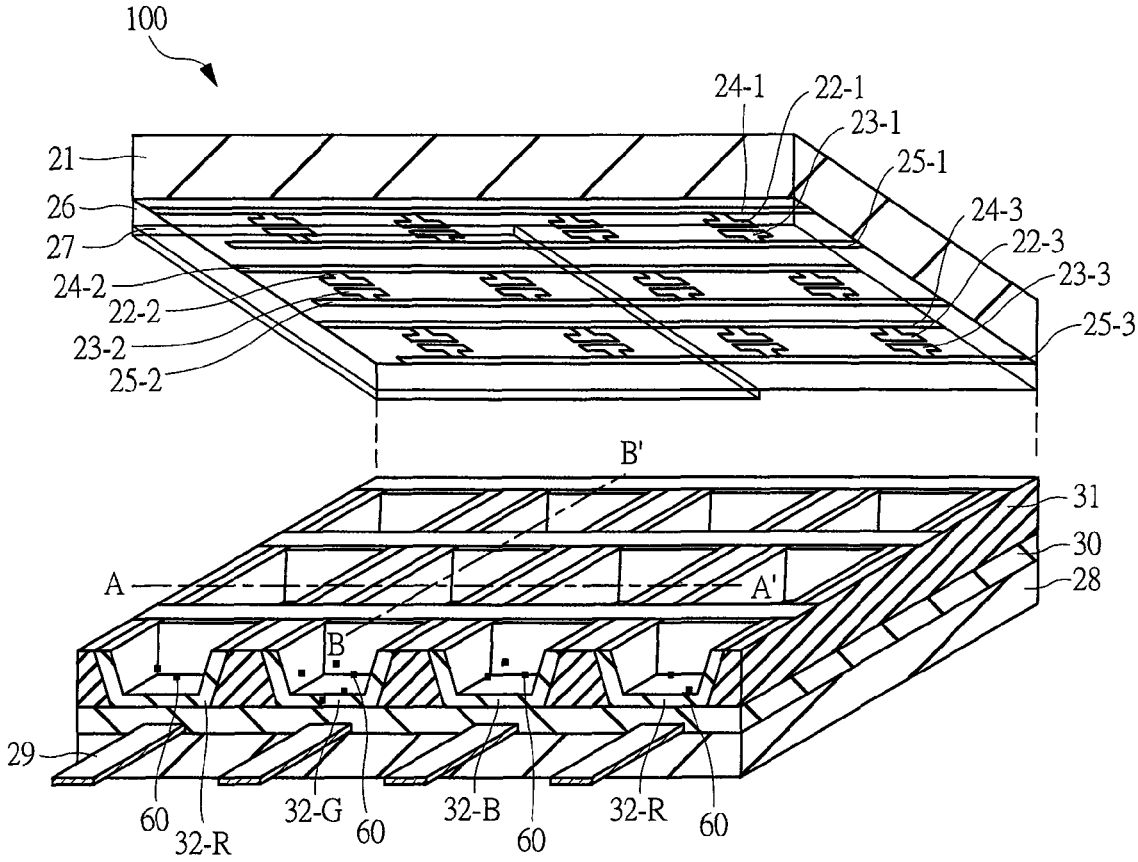
FIG. 1 is a perspective view schematically showing a principal part of a PDP according to one embodiment of the present invention.
Figure 2:
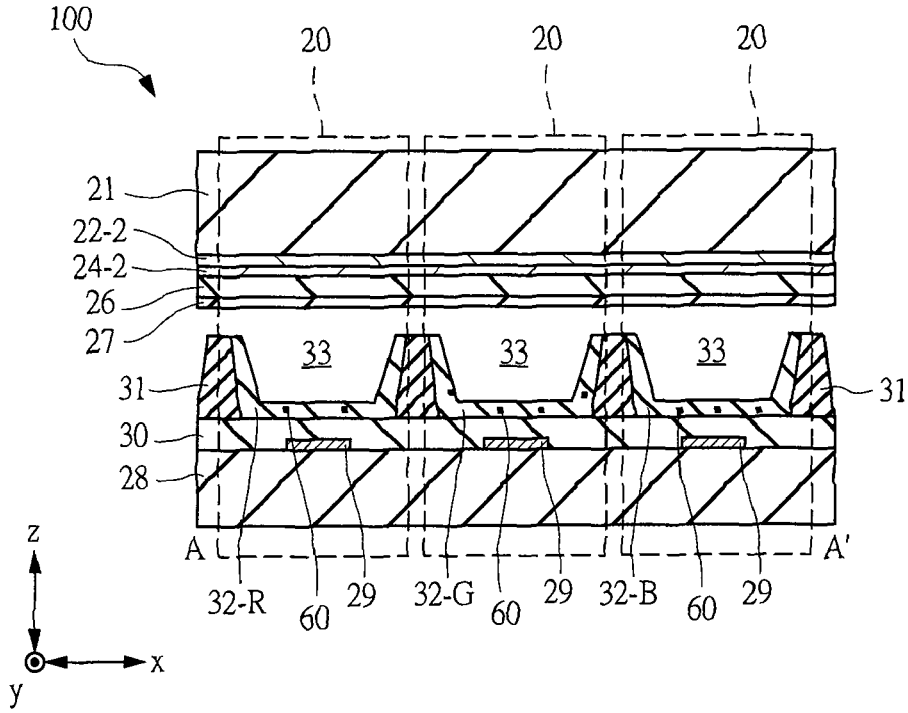
FIG. 2 is a cross-sectional view taken along the line A-A' of FIG. 1.
Figure 3:
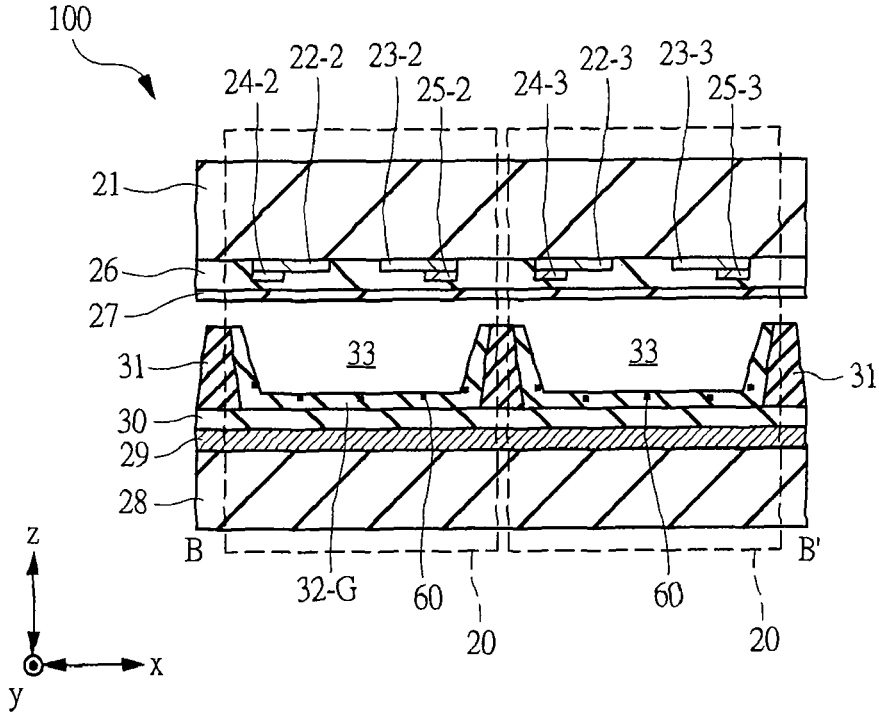
FIG. 3 is a cross-sectional view taken along the line B-B' of FIG. 1.

FIG. 1 is a perspective view schematically showing a principal part of a PDP 100 according to the present embodiment, FIG. 2 is a cross-sectional view taken along the line A-A' of FIG. 1, and FIG. 3 is a cross-sectional view taken along the line B-B' of FIG. 1. Although a front substrate 21 is illustrated so as to be away from a back substrate 28 in the PDP 100 shown in FIGS. 1 to 3 for easily understanding its configuration, the front substrate 21 and the back substrate 28 are attached to be combined so as to face each other in their thickness direction (z direction). Also, in FIG. 1, a dielectric layer 26 and a protective film 27 are illustrated in a perspective manner, and further, the protective film 27 is illustrated in a partly-missing manner.

The PDP 100 has a configuration in which the front substrate 21 to be a substrate of the display surface side and the back substrate 28 to be a substrate of the back surface side are arranged so as to face each other. X electrodes 22 (22-1, 22-2, 22-3, . . . ) and Y electrodes 23 (23-1, 23-2, 23-3, . . . ) which configure a plurality of sustain discharge electrode pairs extending in a first direction (x direction) are provided on the front substrate 21, and A electrodes 29 configuring a plurality of address electrodes extending in a second direction (y direction) intersecting with the first direction are provided on the back substrate 28.

In the PDP 100, each of a plurality of discharge cells 20 is provided at each of the positions at which the plurality of sustain discharge electrode pairs (pairs of X electrode 22 and Y electrode 23) and the plurality of address electrodes (A electrode 29) intersect. Each of the plurality of discharge cells 20 includes: a discharge gap 33 provided between the front substrate 21 and the back substrate 28 facing the front substrate 21 and surrounded by barrier ribs 31 on the back substrate 28; a discharge gas (not shown) containing Xe for filling the discharge gap 33; and a phosphor layer 32 provided on the back substrate 28 so as to contact with the discharge gap 33 for emitting light of any one of red (32-R), blue (32-B), and green (32-G).

The PDP 100 is a surface discharge type in which a display discharge is generated between X electrode 22 and Y electrode 23 provided on the same substrate (front substrate 21) and configuring the sustain discharge electrode pair, and is driven by an alternating drive. The alternating-current surface discharge type has an excellent structure in its simple structure and high reliability.

The front substrate 21 is configured with a transparent substrate such as, for example, a glass substrate, and has the pair of the sustain discharge electrodes formed on a surface facing the back substrate 28 in parallel at a constant distance. The pair of sustain discharge electrodes is configured with X electrode 22 which is a common electrode and Y electrode 23 which is an independent electrode, and the pair is provided so as to extend in the x direction. The X electrode 22 and Y electrode 23 are made of a transparent conductive material such as, for example, ITO (Indium Tin Oxide) for allowing emitted light out. Also, X bus electrodes 24 (24-1, 24-2, 24-3, . . . ) and Y bus electrodes 25 (25-1, 25-2, 25-3, . . . ) which are opaque and for compensating the conductivity are provided so as to contact with each of the X electrodes 22 and Y electrodes 23 and extend in the x direction. Each of the X bus electrodes 24 and Y bus electrodes 25 is made of a low-resistance material such as, for example, silver, copper, or aluminum.

The X electrode 22, the Y electrode 23, the X bus electrode 24, and the Y bus electrode 25 are insulated from the discharge for the alternating drive, and these electrodes are covered by the dielectric layer 26. The dielectric layer 26 is made of a transparent insulating material such as, for example, a glass-based material containing $SiO_2$ or $B_2O_3$ as a main component for protecting the electrodes and for giving a memory function by forming wall charges on a surface of the dielectric layer at discharge. The dielectric layer 26 is covered by the protective film 27 for avoiding damage due to the discharge. The protective film 27 is made of a material such as, for example, magnesium oxide (MgO).

In this manner, the X bus electrode 24, the Y bus electrode 25, and the sustain discharge electrode pair of the X electrode 22 and the Y electrode 23 which are provided together in a lateral direction of the bus electrodes to form display lines are arranged on the front substrate 21. These electrodes are covered by the dielectric layer 26, and the protective film 27 containing magnesium oxide as a main component is formed so as to cover the dielectric layer.

The back substrate 28 is formed of, for example, a glass substrate and has the A electrode 29 being the address electrode provided on the surface facing the front substrate 21 and extending in the y direction so as to three-dimensionally intersect with the X electrode 22 and the Y electrode 23 on the front substrate 21. The A electrode 29 is covered by a dielectric layer 30 for insulating itself from the discharge.

On the dielectric layer 30, barrier ribs (also called ribs) 31 for sectioning the A electrode 29 are provided in a box shape for preventing a spread of the discharge (defining a region of the discharge). The barrier ribs 31 are made of, for example, a transparent insulating material such as a glass material containing $SiO_2$ or $B_2O_3$ as a main component. In the PDP 100, a pitch between the barrier ribs 31 adjacent to each other is made narrow, along with achieving high definition.

In the region divided by the barrier ribs 31 above each of the A electrodes 29, a phosphor layer 32 is provided so as to cover a side surface between the barrier ribs 31 and a surface (trench surface between the barrier ribs 31) of the dielectric layer 30. For the phosphor layers 32, the phosphor layer 32-R for red light emission, the phosphor layer 32-G for green light emission, and the phosphor layer 32-B for blue light emission are used.

In this manner, the A electrode 29 is formed on the back substrate 28, the dielectric layer 30 is formed so as to cover the A electrode 29, and they are divided into the discharge cells 20 for pixel formation by the barrier rib 31. Each of phosphor layers 32 for emitting lights of red, green, and blue is sequentially coated so as to cover the trench surface between the barrier ribs 31. A configuration of the phosphor layer 32 which is a feature of the PDP of the present embodiment will be described later.

Directions of the front substrate 21 and the back substrate 28 are aligned such that the A electrode 29 on the back substrate 28 side and the pair of the X electrode 22 and the Y electrode 23 on the front substrate 21 intersect with each other at a substantially right angle (or, depending on the case, simply intersect with each other), and the front substrate 21 and the back substrate 28 are sealed by low melting point glass (sealing glass) coated on a periphery portion of the substrates. Also, the front substrate 21 and the back substrate 28 are attached to each other so as to make a gap of about 100 μm, and the gap configures a discharge gap 33. A discharge gas irradiating vacuum ultraviolet rays by the discharge between the X electrode 22 and the Y electrode 23 is encapsulated (filled) in the discharge gap 33, and the discharge gas contains Xe and is formed of, for example, a mixture gas (rare gas) Xe 12%-Ne 88%.

In this manner, the PDP 100 has a simple structure, and the discharge is generated in desired discharge cells among the plurality of discharge cells 20 by selectively applying voltage to the sustain discharge electrode pair (X electrode 22 and Y electrode 23) on the front substrate 21 side and the address electrode (A electrode 29) on the back substrate 28 side. Vacuum ultraviolet rays are generated by the discharge, and the generated vacuum ultraviolet rays excite the phosphor layer 32 of each color provided on the back substrate 28 of the discharge gas side, so that the light emissions of red, green, and blue are generated to perform full color display.

Figure 4:
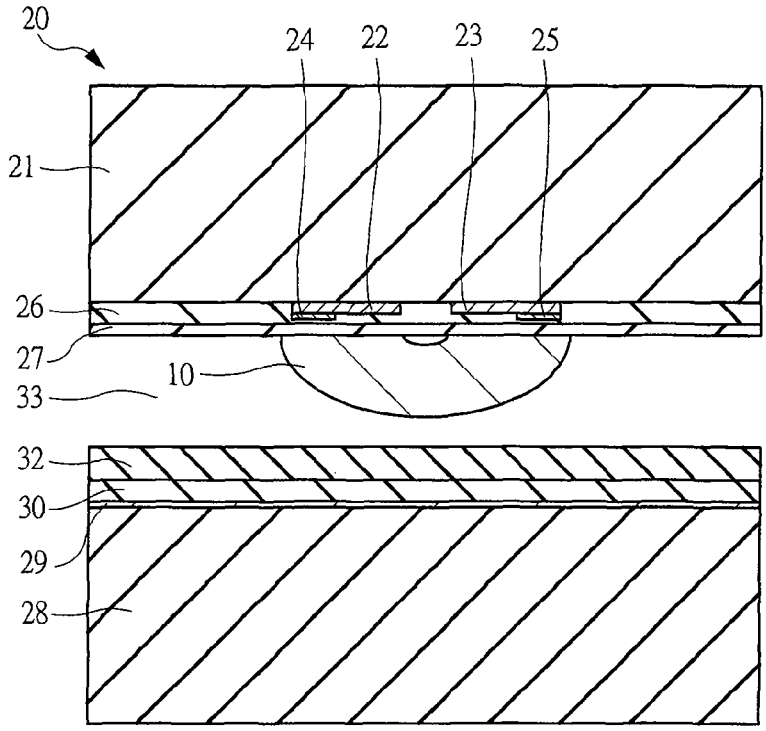
FIG. 4 is a diagram schematically illustrating plasma caused in a discharge cell.

FIG. 4 is a diagram schematically illustrating plasma 10 generated in the discharge cells 20, and FIG. 4 shows one discharge cell which is a minimum unit of a subpixel. In the discharge gap 33, the discharge gas (not shown) for generating the plasma is filled. When a voltage is applied between the X electrode 22 and the Y electrode 23, the plasma 10 is generated by ionization of the discharge gas. Ultraviolet rays from the plasma 10 excite the phosphor layer 32 to emit light, and the light emission from the phosphor layer 32 transmits through the front substrate 21, so that a display screen is configured by the light emission from each of the discharge cells.

Figure 5:
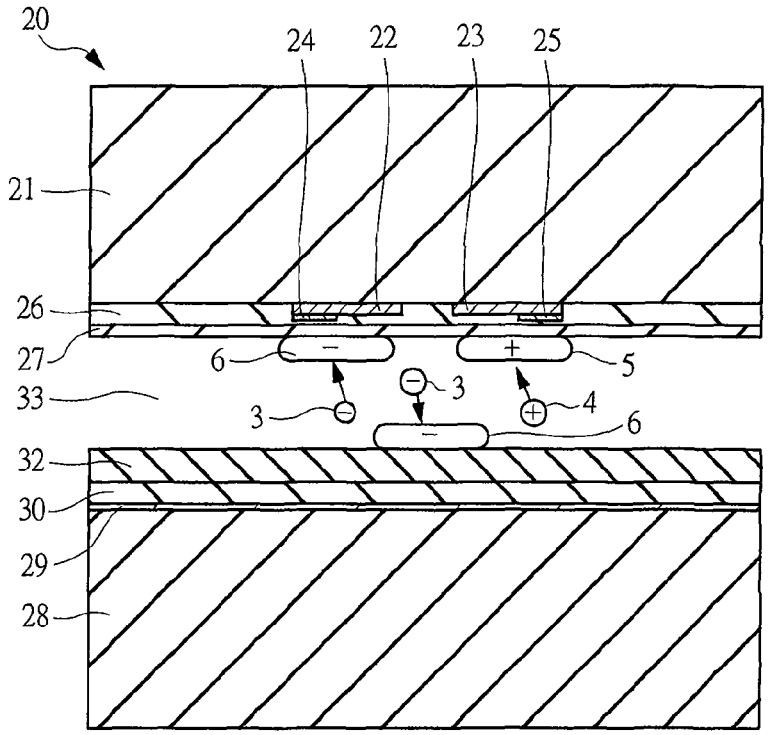
FIG. 5 is a diagram schematically illustrating movements of charged particles in the plasma of FIG. 4.

FIG. 5 is a diagram schematically illustrating movements of charged particles (particles having positive or negative charges) in the plasma 10 in FIG. 4. The reference numeral 3 in FIG. 5 indicates a particle (for example, electron) having negative charge, the reference numeral 4 indicates a particle (for example, positive ion) having positive charge, the reference numeral 5 indicates a positive wall charge, and the reference numeral 6 indicates a negative wall charge. FIG. 5 shows a state of charges at certain period during PDP drive, and specific meaning does not exist in these charge arrangements.

FIG. 5 shows a schematic diagram in which, as an example, a negative voltage is applied to the Y electrode 23, a (relatively) positive voltage is applied to the A electrode 29 and the X electrode 22, so that the discharge is generated and finished. As a result, there is performed a formation (this is referred to as writing) of the wall charge which becomes a subsidiary for starting the discharge (firing) between the Y electrode 23 and the X electrode 22. When a proper opposite charge is applied between the Y electrode 23 and the X electrode 22 in this state, the discharge is caused between the two electrodes via the dielectric layer 26 (and the protective film 27). After finishing the discharge, when the applied voltage between the Y electrode 23 and the X electrode 22 is reversed, the discharge is caused again. By repeating in this manner, the discharge can be continuously formed. This is called sustain discharge.

Figure 6:
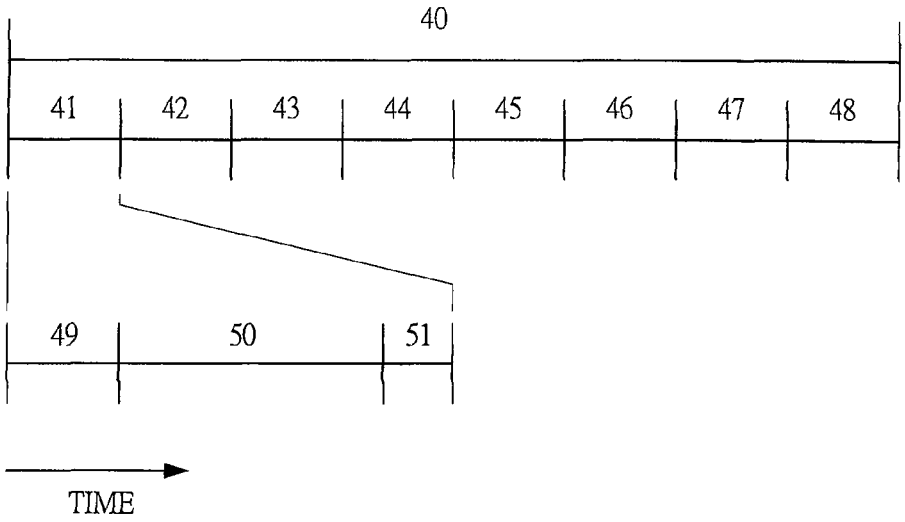
FIG. 6 is a time chart showing a period of one TV field required for displaying one image on the PDP of FIG. 1.

FIG. 6 is one example of a time chart for a period of one TV field required for displaying one image on the PDP 100 shown in FIG. 1. The period of one TV field 40 is divided into subfields 41 to 48 each having a different number of cycles of a plurality of light emissions. The grayscale is expressed by selecting either light emission or no light emission in each of these subfields. Each of these subfields is configured with a reset period 49, an address discharge period 50 for defining an emitting cell, and a sustain discharge period 51.

Figure 7:
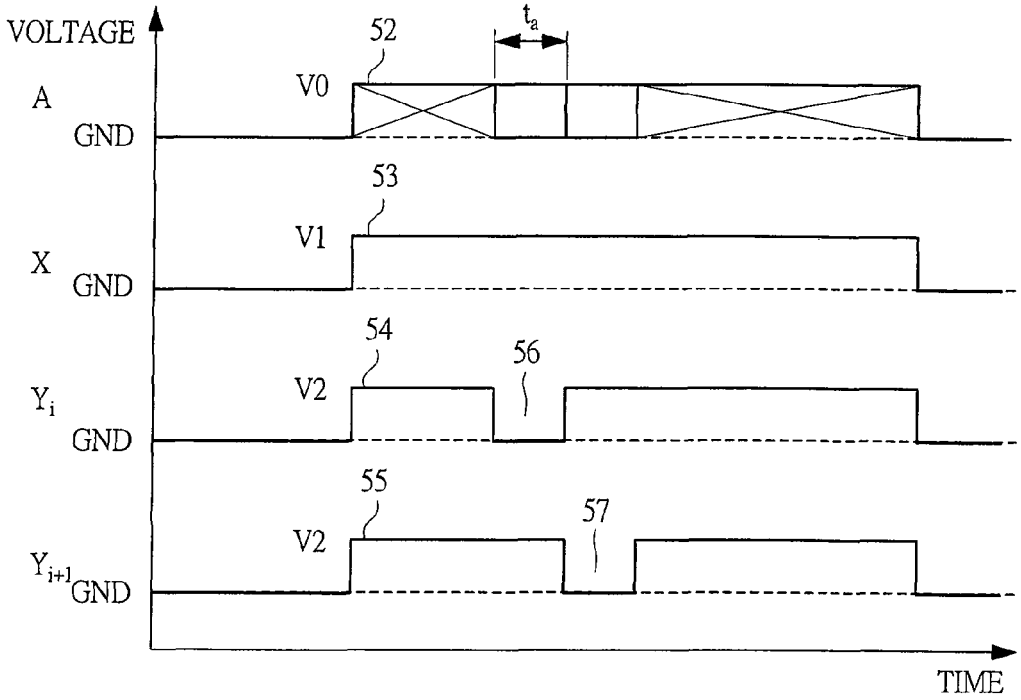
FIG. 7 shows voltage waveforms applied to an A electrode, an X electrode, and a Y electrode in an address discharge period of FIG. 6.

FIG. 7 shows voltage waveforms applied to the A electrode, the X electrode, and the Y electrode in the address discharge period 50 of FIG. 6. The reference numeral 52 in FIG. 7 indicates a voltage waveform applied to one line of the A electrodes in the address discharge period 50, the reference numeral 53 indicates a voltage waveform applied to the X electrode, the reference numerals 54 and 55 indicate voltage waveforms applied to i-th and (i+1)-th ones of the Y electrodes, respectively, and these voltages are V0, V1, and V2, respectively. In FIG. 7, a width of a voltage pulse applied to the A electrode is indicated by "$t_a$".

According to FIG. 7, when a scan pulse 56 is applied to i-th row of the Y electrodes, the address discharge is caused at a cell positioned at an intersection of the A electrode and the i-th Y electrode. A scan pulse 57 can be similarly applied to the i+1-th Y electrode. Also, when the scan pulse 56 is applied to the i-th row of the Y electrodes, and if the A electrode is at a ground potential (GND), the address discharge is not caused. In this manner, the scan pulse is applied once to the Y electrode in the address discharge period 50, so that the A electrode is at V0 in the emitting cell and is at the ground potential in the non-emitting cell in response to the scan pulse. In the discharge cell in which the address discharge is caused, charges generated by the discharge are formed on surfaces of the dielectric layer 26 and the protective film 27 which covers the Y electrode. On and off of the sustain discharge can be controlled by support of an electric field generated by the charges. That is, the discharge cell in which the address discharge is caused becomes the emitting cell, and the other becomes the non-emitting cell.

Figure 8:
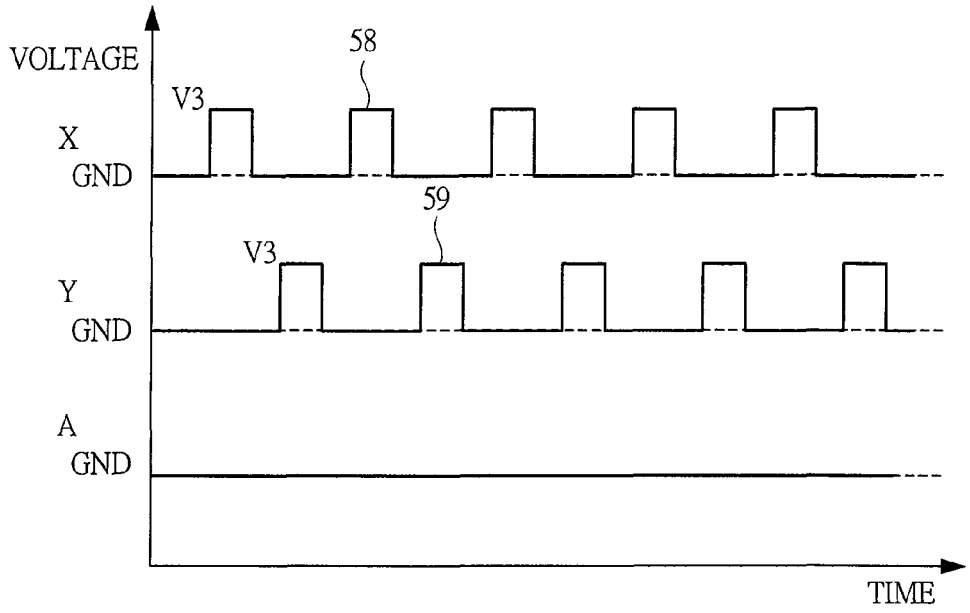
FIG. 8 shows voltage waveforms applied to the A electrode, the X electrode, and the Y electrode in a sustain discharge period of FIG. 6.

FIG. 8 shows voltage waveforms applied to the A electrode, the X electrode, and the Y electrode in the sustain discharge period 51 of FIG. 6, and it shows voltage pulses simultaneously applied between the X electrode and the Y electrode which are the sustain discharge electrodes. A voltage waveform 58 is applied to the X electrode, and a voltage waveform 59 is applied to the Y electrode. By alternately applying pulses of voltages V3 each having the same polarity to both of the electrodes, inversion is repeated in relative voltages between the X electrode and the Y electrode. The discharge caused between the X electrode and the Y electrode in the discharge gas during this is called the sustain discharge, and sustain discharges are performed in a pulsed manner.

Figure 9:
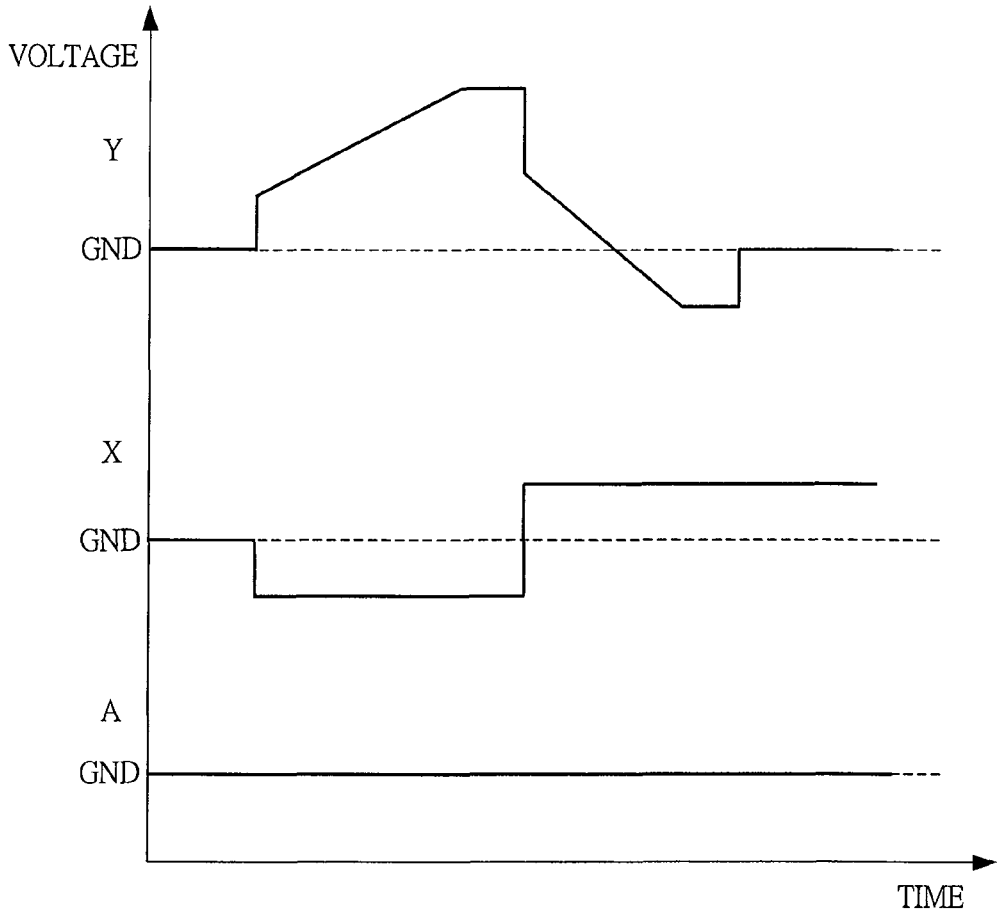
FIG. 9 shows voltage waveforms applied to the A electrode, the X electrode, and the Y electrode in a reset period of FIG. 6.
Figure 10:
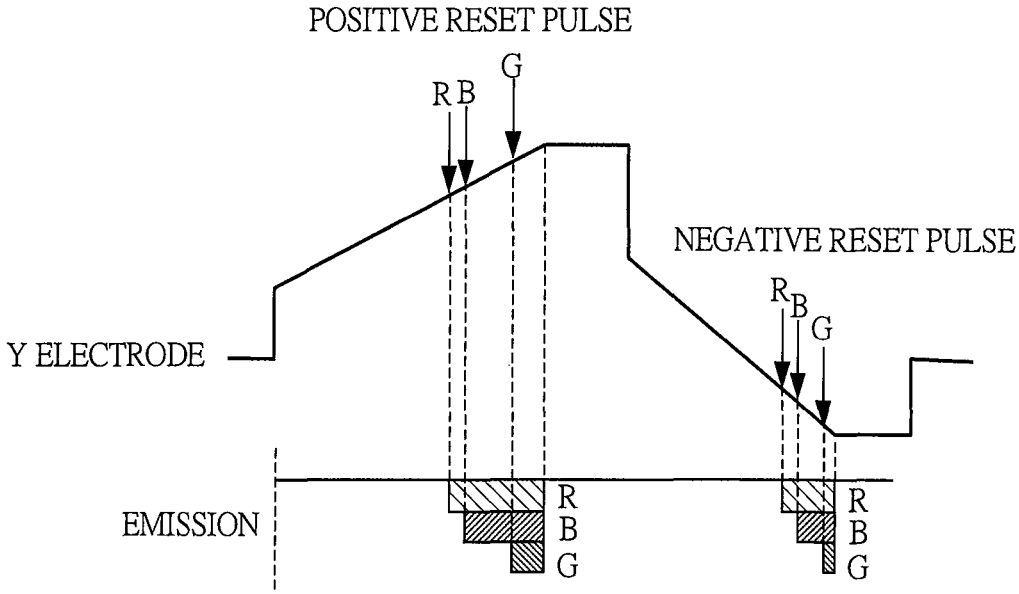
FIG. 10 is a diagram schematically showing emission quantity (emission) in the reset period before applying the present invention.

Also, a role of the reset period 49 shown in FIG. 6 is to reset a history (wall charges) of the discharge in the previous subfield, to make states of wall charges uniform in all of the discharge cells, and to set the charge states in the discharge cells so as to smoothly move to the address discharge. FIG. 9 is a diagram showing voltage waveforms applied to the A electrode, the X electrode, and the Y electrode in the reset period 49 of FIG. 6. Further, FIG. 10 is a diagram schematically showing light emission quantity in the reset period before applying the present invention. Note that FIG. 10 shows, as one example, a case that the phosphor layer for red light emission is made of only a phosphor material of (Y,Gd)$BO_3$:$Eu^{3+}$, the phosphor layer for green light emission is made of only a phosphor material of $Zn_2SiO_4$:$Mn^{2+}$, and the phosphor layer for blue light emission is made of only a phosphor material of $BaMgAl_{10}O_{17}$:$Eu^{2+}$.

When a positive voltage is applied to the Y electrode and the voltage is gradually increased, the voltage goes over a firing voltage at a certain level (indicated by arrows in FIG. 10), so that weak discharge is caused (positive reset). While a voltage equal to or larger than firing voltages of the sustain discharge and the address discharge is applied so that wall charges in all of the discharge cells of red, blue, and green (respective colors are indicated by R, B, and G) are made substantially uniform by the reset discharge, the weak discharge is a discharge weaker in discharge intensity than the sustain discharge and the address discharge. When the voltage is further increased, negative charges caused by the weak discharge are formed on the surface of the protective film on the Y electrode, so that the applied voltage in the discharge cell is maintained at the firing voltage.

When the voltage is lowered from that point, the discharge is not caused for a while, and as the voltage is further lowered, the weak discharge is started (negative reset) at a certain level (indicated by arrows in FIG. 10). A firing voltage of the weak discharge of the negative reset is a firing voltage of a weak discharge having an opposite polarity to the firing voltage of the weak discharge of the positive reset. Here, when the negative voltage reaches a lowest voltage, all of the discharge cells of red, blue, and green (respective colors are indicated by R, B, and G) reach the firing voltage of the weak discharge, so that the states of all of the discharge cells are made uniform. In other words, the reset voltage is set such that the states of all of the discharge cells become the same.

Note that excessive negative wall charges formed at the positive reset on the surface of the protective film on the Y electrode side are removed by the weak discharge of the negative reset, and the weak discharge is started in all of the discharge cells by applying a voltage of the lowest voltage of the negative reset or lower. After recovering the voltage from this point, the address discharge period 50 is started, so that scanning as shown in FIG. 7 is started. For stably operating the address discharge, a negative voltage of the lowest voltage of the negative reset or slightly larger is applied as the voltage of the scan pulse, so that the address discharge is caused in the cell to which the address pulse is being applied.

In this manner, a role of the reset is to make the states of the wall charges of all of the discharge cells uniform, and to set the charge states of the discharge cells so as to smoothly move to the address discharge. For this, it is necessary that the voltage amplitude from the positive reset to the negative reset is a sum of the weak discharge firing voltage at the positive reset and the weak discharge firing voltage at the negative reset. In the positive reset and the negative reset, it is important to make the firing voltages uniform of the weak discharges of the positive reset and the negative reset as much as possible in each discharge cell for reducing the weak discharge as little as possible to reduce unnecessary light emission due to the weak discharge.

However, the firing voltage of the weak discharge in the reset is significantly different in each color of the phosphors as shown in FIG. 10. Therefore, the reset voltage is required to be set in accordance with the voltage having a higher weak discharge firing voltage for making the states uniform of all of discharge cells, and therefore, a phosphor of a color having a lower weak discharge firing voltage is applied with a voltage over its discharge firing voltage, and the phosphor is required to continue the weak discharge until a discharge cell having the higher weak discharge firing voltage starts its weak discharge. Therefore, the discharge cell having the lower weak discharge firing voltage is required to perform more unnecessary weak discharge, thereby causing more unnecessary light emission.

The difference of the weak discharge firing voltage in each phosphor depends on a secondary electron emission coefficient or a charged amount of the phosphor. Also, although it is effective to use phosphors of respective colors having weak discharge firing voltages close to each other, it is difficult to select ones which are good in color, image smear characteristics, and the like and satisfy the above-described conditions, and it is extremely difficult to make their weak discharge firing voltages completely uniform.

Figure 11:
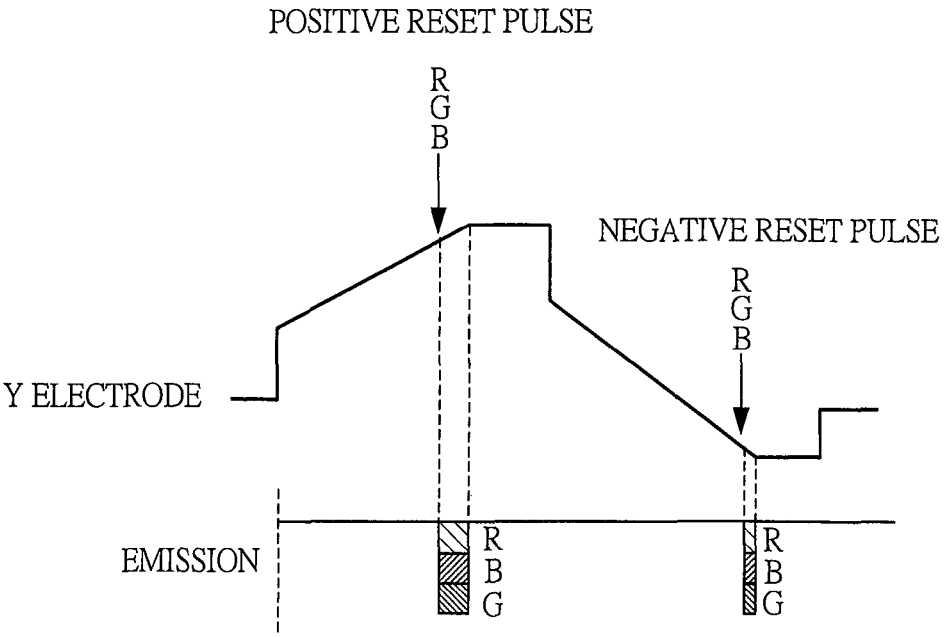
FIG. 11 is a diagram schematically showing light emission quantity in the reset period of the PDP of FIG. 1.

Here, crystal materials 60 having different concentrations are arranged in respective phosphor layers 32 of red, green, and blue in the PDP 100 according to the present embodiment described in FIGS. 1 to 3, and the reset periods of the PDP 100 and a PDP in which the crystal material is not arranged will be compared with reference to FIGS. 10 and 11. FIG. 11 is a diagram schematically illustrating light emission quantity in the reset period of the PDP of FIG. 1, and this is the case that the crystal material is arranged in the phosphor layer. Compared to this, FIG. 10 is the case that the crystal material is not arranged in the phosphor layer. Note that, a phosphor material of, for example, $(Y,Gd)BO_3:Eu^{3+}$ is used for the phosphor layer 32-R for red light emission, a phosphor material of, for example, $Zn_2SiO_4:Mn^{2+}$ is used for the phosphor layer 32-G for green light emission, and a phosphor material of, for example, $BaMgAl_{10}O_{17}:Eu^{2+}$ is used for the phosphor layer 32-B for blue light emission.

Also, one example of the waveform of the Y electrode reset and light emission quantity at the time are schematically illustrated in both of FIGS. 10 and 11, and R, G, and B indicate discharge cells of red color, green color, and blue color, respectively. Further, arrows shown in FIGS. 10 and 11 indicate average values of firing voltages of the weak discharges. A reason of indicating the average values is because the firing voltages of the weak discharges have some difference from each other even if they are discharge cells having the same color. Strictly speaking, for resetting all of the cells, it is required to consider a cell having a high firing voltage of its weak discharge.

When the firing voltage of the weak discharge of each phosphor is different from one another as shown in FIG. 10, unnecessary light emission is increased as described below. When the positive reset voltage is gradually raised, the discharge is started from the red phosphor having the lower weak discharge firing voltage at a voltage pointed to by "R" in FIG. 10. And then, the weak discharge of the blue phosphor is started at a voltage pointed to by "B" in FIG. 10, and the weak discharge of the green phosphor is not started until the voltage is further raised up to a voltage pointed to by "G" in FIG. 10. Here, since the positive reset voltage is required to be raised until the weak discharge of the discharge cell of the green color is started as shown in FIG. 10, and the red phosphor is continuing to emit light during that time, it can be seen that the light emission quantity of the red phosphor having the lowest weak discharge firing voltage is largest.

And then, in the red phosphor having the lowest weak discharge firing voltage, wall charges more than necessary are formed therein because of more weak discharge, its weak discharge is started first when the voltage is lowered in the negative reset, and its weak discharge more than necessary compared to the other phosphors is required to be performed, and therefore, unnecessary light emission is increased.

Therefore, if the firing voltage of the weak discharge of each discharge cell is made uniform, unnecessary light emission can be reduced. Accordingly, in the present embodiment of the present invention, the discharge firing voltage of the weak discharge is made uniform in each color, and its behavior is shown in FIG. 11.

As shown in FIG. 11, it can be seen that the weak discharges are started at the same voltage and the light emission quantity accompanied by the weak discharge of each color is significantly reduced. The reason is because the unnecessary light emission is not required as described above, so that the unnecessary light emission is reduced. Ideally, when the discharge firing voltages of each color are strictly the same with each other, it is possible not to emit light at all if the voltage application is stopped at the moment of causing the weak discharge. Note that, since the firing voltages of the weak discharges are slightly different from each other due to variations in a manufacture process of each cell even if the cells have the same color, the light emission has to be slightly caused for absorbing the difference.

As techniques disclosed in Patent Documents 1 to 4, by forming the layer of the metal fluoride or the metal oxide on the surface of the phosphor layer and mixing magnesium oxide crystal into the portion facing the discharge cell or the phosphor layer, it is considered that the reset voltage causing the reset discharge can be reduced, so that the luminance at black display can be reduced to a certain degree. However, it is clearly stated that the unnecessary light emission cannot be reduced so much by only lowering the voltage of each discharge cell by the same degree, and there are almost no effects. The important thing is to make the discharge firing voltage of each discharge cell uniform. In this manner, if the discharge firing voltages are made uniform at a low voltage, there is an effect of reducing the circuit cost by using a low-voltage element.

Further, when the crystal material is arranged in the phosphor layer, there is also an effect of suppressing increase of the luminance at black display due to occurrence of accidental strong discharge at the reset. The strong discharge is a strong discharge caused accidentally and being as a pulse when the reset voltage is gradually applied in a state that it is difficult to cause the weak discharge due to a discharge delay and the like. Since the strong discharge is accompanied by a strong light emission, deterioration of minimum luminance is caused. Also, since the strong discharge prevents formation of wall charges at the reset, no occurrence of the strong discharge is better.

The strong discharge occurs because it is difficult to cause the weak discharge as described above, and the difficulty of causing the weak discharge is because of a shortage of priming particles which are seeds for the discharge. A mechanism causing the discharge is as follows. A seed electron is generated between electrodes and is accelerated by an electric field to ionize an atom and a molecule, and the ion is impacted to a cathode, and further, a secondary electron is emitted to double the electrons. By repeating in this manner, the discharge is caused. Here, the crystal material is related to the causing of the seed electron. The seed electron which is the seed for the discharge is caused by the emitting of an electron to the discharge gap by the electric field effect and the Auger process, the electron being captured in a trap level existing between a valence band and a conduction band in a crystal energy level and slightly lower than the conduction band. The capture of the electron in the trap level is performed by irradiation of vacuum ultraviolet rays to the crystal material or the impact of the charged particle to the crystal material in a previous discharge of the address discharge. Also, since the crystal material has a secondary electron emission coefficient ($\gamma$) larger than that of the phosphor, the crystal material also performs a role of increasing the secondary electron emission when the address electrode is the cathode. Thereby, it is easy to cause the discharge. In this manner, by arranging the crystal material in the phosphor, the strong discharge can be prevented, and the increase of the luminance at black display can be suppressed. Further, since wall charges can be stably formed at the reset, a stable operation of the PDP is possible.

Next, there will be described configurations of the phosphor layers and a method of making the weak discharge firing voltages uniform which are features of the PDP according to the present embodiment. Note that their discharge cell configurations, their discharge gases, and their protective film materials on the Y electrode side are the same in the respective discharge cells. Therefore, the difference of the weak discharge firing voltage in each phosphor depends on the secondary electron emission coefficient and the charged amount of the phosphor.

As shown in FIGS. 9 and 11, the Y electrode side becomes positive at the positive reset. At this time, the A electrode side on the phosphor side becomes relatively negative. That is, the Y electrode side becomes an anode, and the A electrode side becomes a cathode. At this time, the secondary electron emission coefficient ($\gamma$) of the phosphor is important for the weak discharge firing voltage (the protective film material on the Y electrode side is common in each color). Also, the charged amount is also important. That is, if their secondary electron emission coefficients and their charged amounts of the phosphors of respective colors are the same, their weak discharge firing voltages are the same. Since compositions of the phosphors of respective colors are significantly different, the weak discharge firing voltages of the phosphors of respective colors are different as shown in FIG. 10.

In the present embodiment, a crystal material having a different concentration is arranged in each of the phosphor layers of red, blue, and green so as to make the firing voltages of the reset discharges caused in a plurality of discharge cells uniform. That is, to make the weak discharge firing voltages of the reset discharges of the respective colors uniform by adjusting their secondary electron emission coefficients and their charged amounts of the phosphors of respective colors, it is preferable to mix a material (crystal material 60 of FIGS. 1 to 3) having a secondary electron emission coefficient and a charged amount larger than those of the phosphors into the phosphors.

Also, in a case that charged amounts of a first, a second, and a third phosphor materials of three colors are constant, a case that a secondary electron emission coefficient of the first phosphor material is larger than that of the second phosphor material, and a case that a secondary electron emission coefficient of the second phosphor material is larger than that of the third phosphor material, the crystal material is contained more in the phosphor layer containing the second phosphor material than the phosphor layer containing the first phosphor material, and the crystal material is contained more in the phosphor layer containing the third phosphor material than the phosphor layer containing the second phosphor material, thereby making the weak discharge firing voltages of each color uniform. Note that, in the case that the charged amounts are constant, for example, only charged amounts of the first, the second, and the third phosphor materials may be measured. Further, films for adjusting the amounts may be formed on surfaces of these phosphor materials.

In the present embodiment, the phosphor material (first phosphor material) of $(Y,Gd)BO_3:Eu^{3+}$ is used for the phosphor layer 32-R for red light emission, the phosphor material (third phosphor material) of $Zn_2SiO_4:Mn^{2+}$ is used for the phosphor layer 32-G for green light emission, and the phosphor material (second phosphor material) $BaMgAl_{10}O_{17}:Eu^{2+}$ is used for the phosphor layer 32-B for blue light emission shown in FIGS. 1 to 3. The phosphor materials are not limited to them, and $Y(PV)O_4:Eu^{3+}$ may be used for the phosphor layer 32-R, $YBO_3:Tb^{3+}$ may be used for the phosphor layer 32-G, and $Y(P,V)O_4$ may be used for the phosphor layer 32-B, or a mixture of them and the like may be used for them. Even if any phosphor material is used for them, the important thing is to make the firing voltages of the weak discharges uniform in the reset discharges caused in the plurality of discharge cells by supplying a voltage(s) to the plurality of sustain discharge electrode pairs.

Also, it is required that the crystal material 60 according to the present embodiment may be made of, for example, an oxide or fluoride of alkaline metal, alkaline earth metal, or the like having small work function, and the crystal material may be made of, at least, any one of an alkaline metal oxide, an alkaline earth metal oxide, an alkaline metal fluoride, and an alkaline earth metal fluoride.

In the present embodiment, a magnesium oxide crystal (MgO crystal) is used as the crystal material 60. A manufacture process of the MgO crystal is easy in chemical and physical stabilities, its secondary electron emission coefficient (y) is large, and it functions also as an electron emitting material. Here, it is important to adjust a mixing amount of the MgO crystal into the phosphors of respective colors so as to make the weak discharge firing voltages uniform. Also, a mixture existing on the surface of the phosphor of each color of the above-described mixture is particularly important. The mixture may be arranged on the surface of the phosphor, or a part of the mixture may appear on the surface being mixed into the phosphor.

A formation method of the phosphor layer 32 shown in FIGS. 1 to 3 will be described. First, a phosphor powder and a vehicle are mixed to form a phosphor paste. The MgO crystal is further mixed into the phosphor paste to form a paste with sufficient mixing and deforming by a deforming stirrer. At this time, the MgO crystal is mixed with it changing its concentration in each color paste. The each color paste is printed on a panel, dried, and baked, so that the phosphor is arranged in each cell.

Also, in the present embodiment, although the MgO crystal is mixed into the phosphor pastes and they are printed on the panel, a solution obtained by mixing the MgO crystal into an organic solvent and the like may be sprayed on a surface of a phosphor by a spray method and the like after printing a phosphor paste not containing the MgO crystal on the panel and drying it. In this case, it is important to spray with a different concentration of the solution on the surface of each color of the phosphors by spraying the phosphor having a different color using masking and the like.

Figure 12:
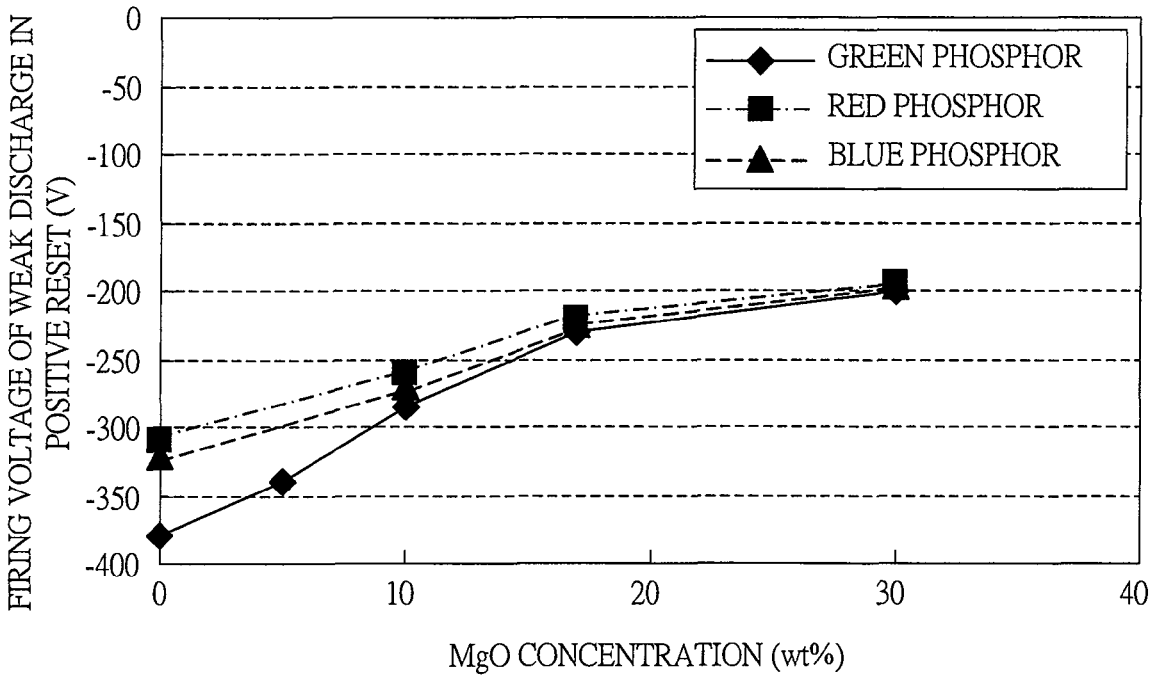
FIG. 12 is a diagram showing a firing voltage of weak discharge in relation to a mixture concentration of MgO crystal.

An object of the PDP 100 according to the present embodiment is to make the weak discharge firing voltages of the reset discharge uniform to reduce the minimum luminance and improve the dark-room contrast. Here, the weak discharge firing voltage of the PDP 100 shown in FIGS. 1 to 3 is evaluated. Such a result is shown in FIG. 12 that the weak discharge firing voltage in the positive reset (when the phosphor is the cathode) is measured with changing the concentration of the MgO crystal mixed into each color. The horizontal axis indicates proportion of an amount of the MgO crystal (crystal material 60) mixed into the phosphors to the entire weight as MgO weight %. The vertical axis shows negative values because the A electrode side is handled as positive, and a small absolute value indicates a low weak discharge firing voltage.

As shown in FIG. 12, at a MgO mixture concentration (MgO concentration) of 0%, the weak discharge firing voltage of the green phosphor is the highest, and the next is that of the blue phosphor, and the lowest is that of the red phosphor. It can be seen that, when the amount of the mixed MgO crystal is increased, the weak discharge firing voltages in the positive reset are lowered in all of the phosphors of red, blue, and green. More particularly, it can be seen that, in the green phosphor, the reduced value of the weak discharge firing voltage to the mixture concentration is significant. It is considered that it is because the weak discharge firing voltage of the green phosphor and the weak discharge firing voltage of the mixed MgO are significantly different from each other. Also, it can be seen that the weak discharge firing voltages tend to saturate with respect to the mixture concentration, with reference to FIG. 12.

For making the weak discharge firing voltages uniform at −300 V with reference to FIG. 12 in configuring the PDP, the MgO crystal of 2% may be mixed into the red phosphor, the MgO crystal of 4% may be mixed into the blue phosphor, and the MgO crystal of 8% may be mixed into the green phosphor. Also, it is found that, for making the weak discharge firing voltages uniform to −250 V, the MgO crystal of 12% may be mixed into the red phosphor, the MgO crystal of 13% may be mixed into the blue phosphor, and the MgO crystal of 15% may be mixed into the green phosphor. If the weak discharge firing voltages are made uniform at −250 V that is lower than −300 V, there is the effect that the circuit cost can be reduced by using a low-voltage element.

In the PDP 100 according to the present embodiment, the MgO crystal of 12% is mixed into the red phosphor, the MgO crystal of 13% is mixed into the blue phosphor, and the MgO crystal of 15% is mixed into the green phosphor. Thereby, the positive reset voltage in the reset period of the PDP 100 is set so as to set a potential between the A electrode and the Y electrode to −250 V. When the minimum luminance of the PDP 100 is measured, it is found that the minimum luminance of the mixture can be reduced to 0.01 cd/m$^2$ as small as one-fiftieth the value 0.5 cd/m$^2$ of the case of not mixing the MgO crystal into each phosphor layer. Thereby, the ratio of the dark-room contrast of 3000 to 1 becomes 150000 to 1, so that a PDP having very high dark-room contrast can be achieved.

As described above, by adjusting the amount of the MgO crystal mixed into the phosphor of each color so as to make the weak discharge firing voltage of each color uniform, the PDP having very high dark-room contrast can be achieved. Also, it is possible to ease transmittance of an optical filter for emphasizing the black display to improve the luminance.

Next, configurations of a plasma display device and an image display system thereof will be described, the plasma display device being configured so as to perform an image display combining the PDP 100 according to the present embodiment and a drive power supply (also called a driving circuit) for driving the PDP 100. The drive power supply receives signals of a display screen from an image source and converts the signal into a driving signal of the PDP to drive the PDP.

Figure 13:
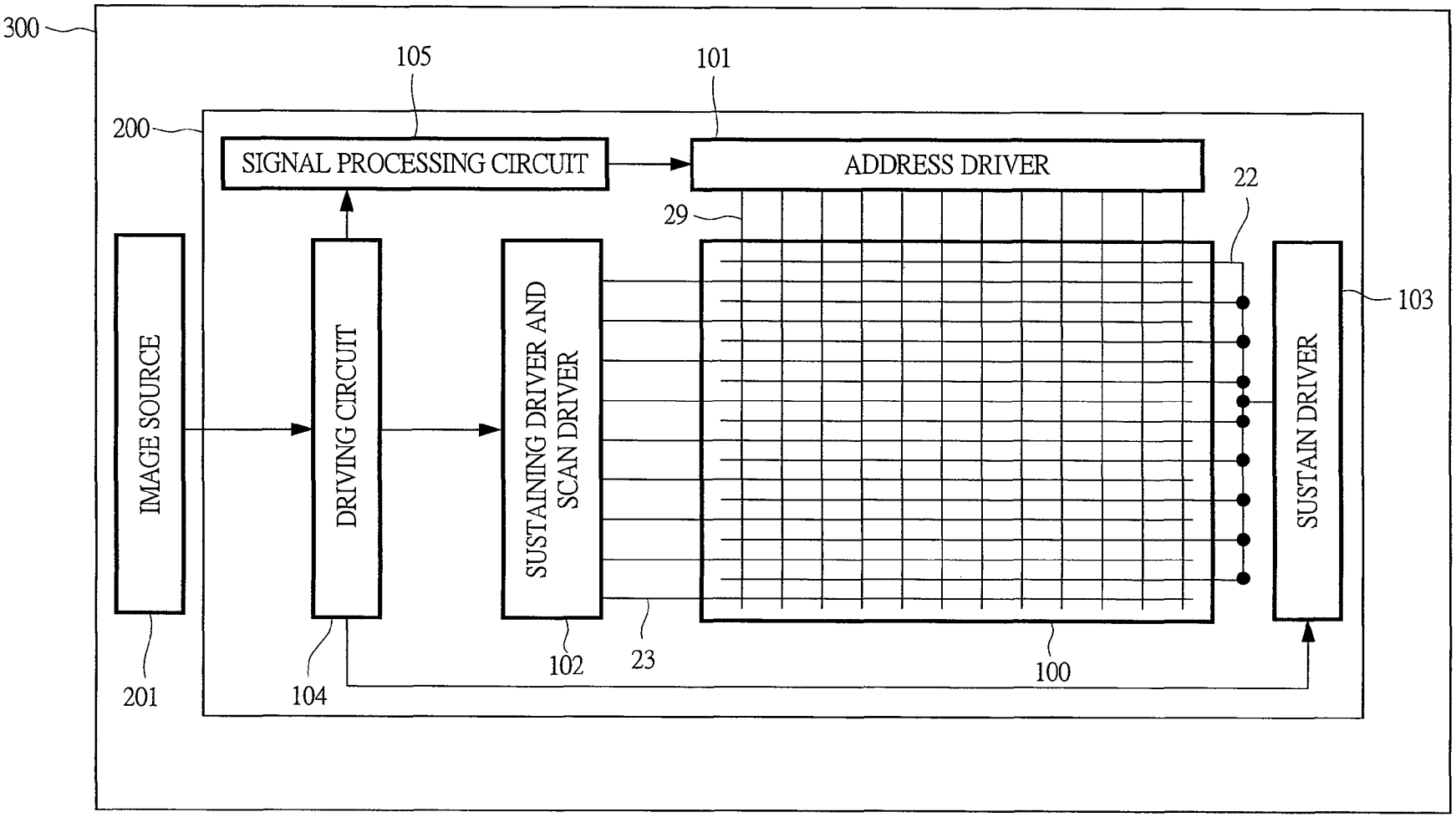
FIG. 13 is an explanatory diagram showing configurations of a plasma display device including the PDP of FIG. 1 and an image display system thereof.

FIG. 13 is an explanatory diagram showing configurations of a plasma display device 200 including the PDP 100 of FIG. 1 and an image display system 300 thereof. The plasma display device 200 has the PDP 100 including: the A electrode 29 which is the address electrode described with reference to FIGS. 1 to 3; the Y electrode 23 which is the one sustain electrode (scan electrode); and the X electrode 22 which is the other sustain electrode. The plasma display device 200 further has: an address driving circuit (address driver) 101 for driving the A electrode 29; a sustain and scan pulse output circuit (sustaining driver and scan driver) 102 for driving the Y electrode 23; a sustain pulse output circuit (sustain driver) 103 for driving the X electrode 22; a driving control circuit (driving circuit) 104 for controlling these output circuits; and a signal processing circuit 105 for processing input signals. Image signals are supplied to the driving control circuit 104 in such a plasma display device 200, and the image display system 300 can be configured with the plasma display device 200 and an image source 201 for generating the image signals.

In the plasma display device 200, after completing the PDP 100, the electrodes of the PDP 100 and a flexible substrate are jointed by an anisotropic conductive film. And then, such a process is performed that a plate made of, for example, aluminum is attached for improving heat dissipation of the PDP 100 and a driving circuit such as the address driver 101 is installed on the plate, so that the plasma display device 200 is completed.

The plasma display device 200 and the image display system thereof include the PDP 100 in which the crystal material is arranged in each of the phosphors 32 of red, green, and blue so as to make the weak discharge firing voltages of the reset discharges uniform. Therefore, by reducing the luminance at black display, the plasma display device 200 including the plasma display panel 100 with improved dark-room contrast and high image quality, and the image display system 300 thereof can be achieved.

Second Embodiment

In the first embodiment, the minimum luminance can be reduced by adjusting the amount of the crystal material (for example, MgO crystal) having the large secondary electron emission coefficient and the large charged amount and mixing the crystal material into the phosphor of each color so as to make the weak discharge firing voltages uniform. However, when too much of the crystal material is mixed in, the phosphor amount is reduced, and, therefore, the reduction in luminance is to be considered. Accordingly, in a second embodiment, a PDP using the crystal material arranged in the phosphor layers with consideration of the luminance of the PDP will be described. Note that descriptions overlapped with those of the first embodiment are omitted.

Figure 14:
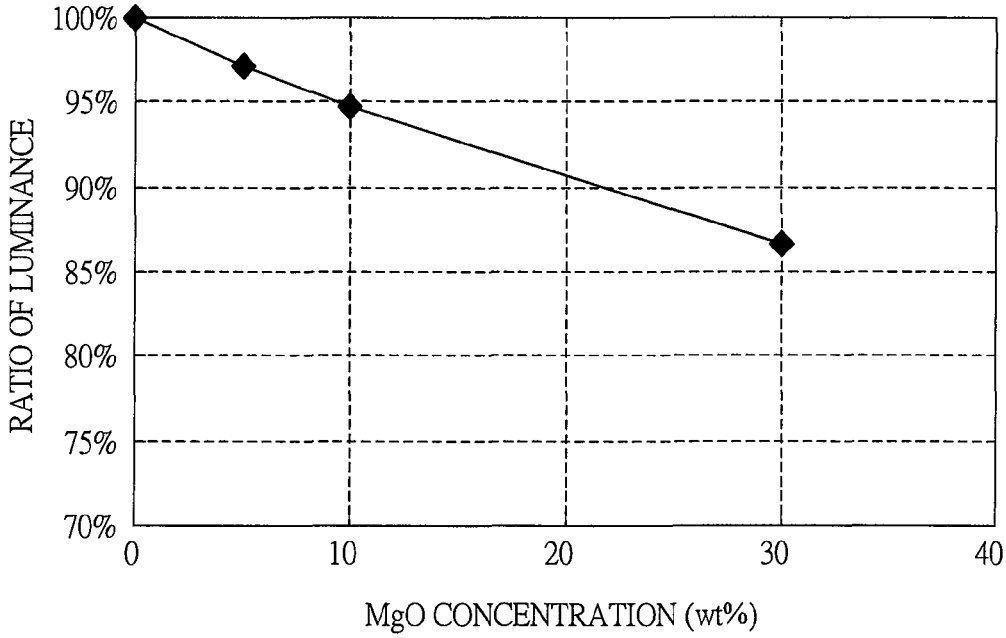
FIG. 14 is a diagram showing a panel luminance (ratio of luminance) in relation to the mixture concentration of MgO crystal.

FIG. 14 is a diagram showing a relation between the mixture concentration of the MgO crystal and a panel luminance. It is found that the luminance is lowered by 9% when the MgO mixture concentration is 20%, and further, the luminance is lowered by 13% when the MgO mixture concentration is 30%. For preventing the reduction of the luminance by 15% or more which can be recognized by vision, it is preferred that the mixture concentration of the MgO crystal is set to 30% or less.

The reduction of the luminance will be described. When vacuum ultraviolet rays of 147 nm and 173 nm caused in plasma are irradiated to the phosphor layer containing the MgO crystal, the ultraviolet rays irradiated to the phosphor are used for the light emission of the phosphor. On the other hand, when the ultraviolet rays are irradiated to the MgO crystal, they are absorbed in the MgO crystal or reflected by the MgO crystal. A part of the ultraviolet rays absorbed in the MgO crystal excites the energy level of the MgO crystal, so that light of 200 nm to 300 nm is emitted. Although the light emission can excite the phosphor, almost all of energy is lost. On the other hand, a part of the ultraviolet rays reflected by the MgO crystal makes the phosphor emit light.

This phenomenon can be confirmed by the following experiments. First, when a lamp light with 146 nm wavelength is irradiated to a sample in which the mixture concentration of the MgO crystal is changed to observe the change of the luminance, the luminance is lowered as much as a surface coverage of the MgO crystal on the surface of the phosphor layer. The surface coverage is an amount proportional to the mixture concentration. That is, it is found that almost all of the vacuum ultraviolet rays of 147 nm irradiated to the MgO crystal are not used for the excitation of the phosphor. Next, when a lamp light with 172 nm wavelength is irradiated to a sample in which the mixture concentration of the MgO crystal is changed to observe the change of the luminance, the luminance is lowered by a rate about a half of the surface coverage of the MgO crystal on the surface of the phosphor layer. That is, it is found that about a half of vacuum ultraviolet rays of 173 nm irradiated to the MgO crystal are used for the excitation of the phosphor.

Figure 15:
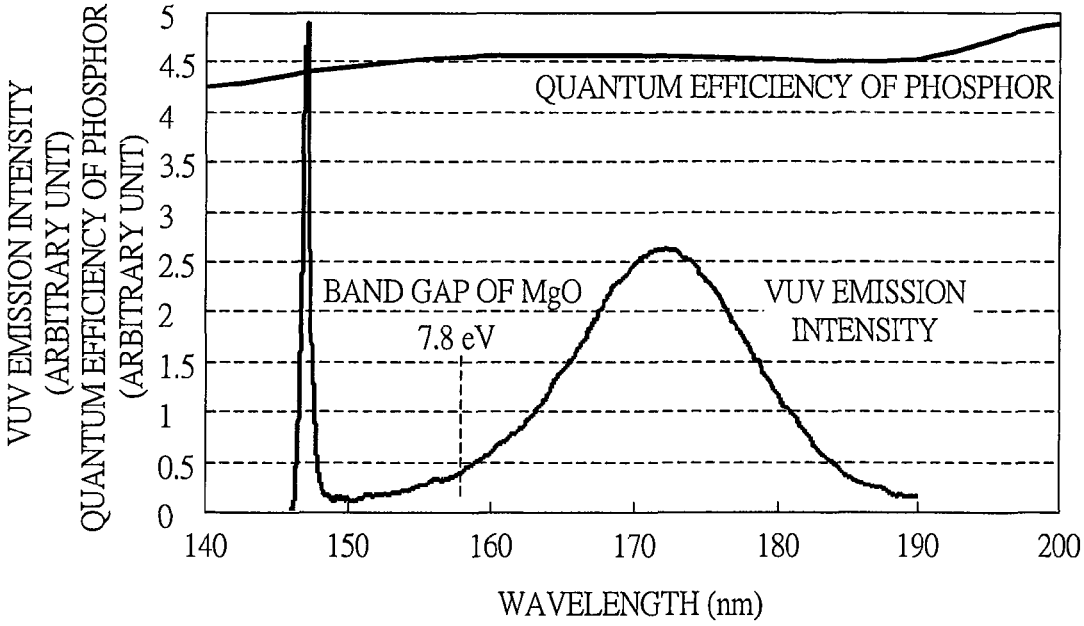
FIG. 15 is a diagram showing emission intensity of vacuum ultraviolet rays (VUV) and quantum efficiency of a phosphor.

The difference of the luminance reduction depending on the difference of the wavelength of the vacuum ultraviolet rays is posed by the following reasons. FIG. 15 is a diagram showing emission intensity of vacuum ultraviolet rays (VUV) and quantum efficiency of the phosphor, and shows a light emission spectrum of the ultraviolet rays of Xe of 12% and quantum efficiency of the phosphor used in the present embodiment. In a region of vacuum-ultraviolet-ray emission of Xe, the quantum efficiency of the phosphor is little changed. Also, a band gap of the MgO is shown in FIG. 15. Energy of the band gap is about 7.8 eV, and the energy corresponds to energy of ultraviolet rays of about 159 nm. Here, ultraviolet rays of about 159 nm or shorter are absorbed, and ultraviolet rays of about 159 nm or longer are reflected. Strictly, vacuum ultraviolet rays having a wavelength longer than 159 nm are also absorbed a little in a perturbed surface energy level.

In the foregoing, for suppressing the luminance reduction, it is required to increase vacuum ultraviolet rays at the wavelength longer than about 159 nm. That is, it is required to increase molecular emission of 173 nm by Xe. For increasing the molecular emission of 173 nm by Xe, it is required to increase the Xe concentration of the discharge gas.

Figure 16:
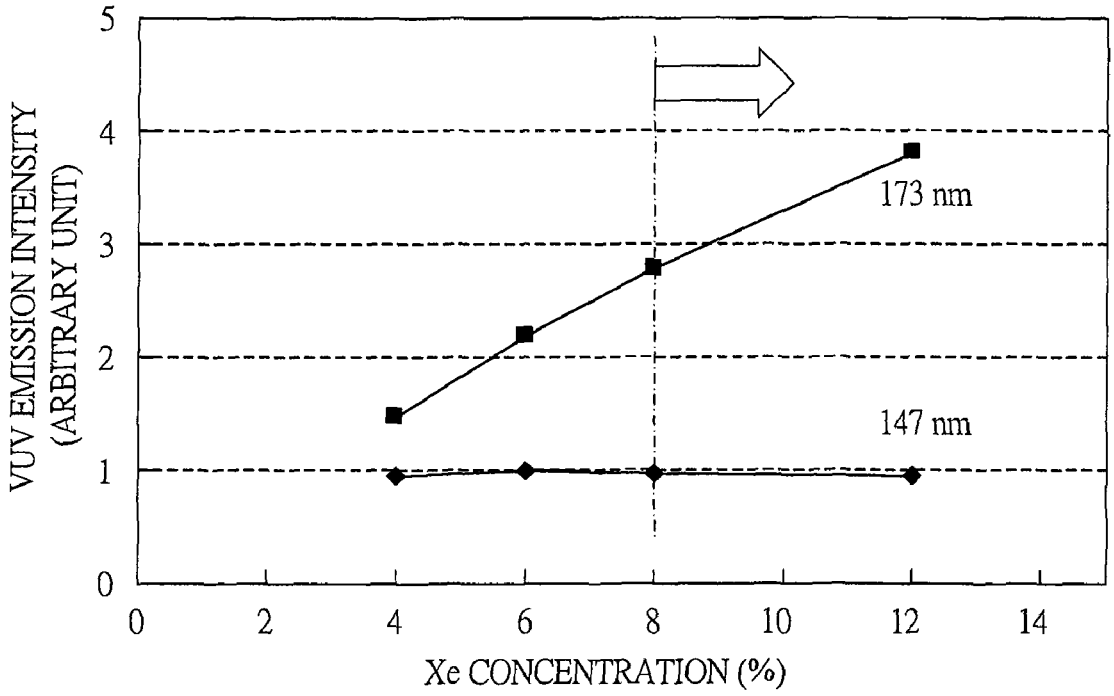
FIG. 16 is a diagram showing the ultraviolet-ray (VUV) emission intensity in relation to a Xe concentration.

FIG. 16 is a diagram showing the ultraviolet-ray emission intensity in relation to the Xe concentration. The Xe concentration is expressed by volume percentage in ideal gas and it is a ratio of Xe in the entire discharge gas. In the ideal gas, the concentration is the same value as the mole fraction. It is found that the vacuum ultraviolet rays of 173 nm increase together with the Xe concentration. This is because, while the vacuum ultraviolet rays of 147 nm correspond to a resonance line, those of 173 nm correspond to the molecular emission of $Xe_2$ molecular. In other words, this is because the Xe molecular formation increases together with the Xe concentration. On the other hand, this is because, although the excitation ratio in the resonance line of 147 nm also increases together with the Xe concentration, the absorption ratio and the deactivation ratio also increases by resonance trapping.

Here, the higher the Xe concentration, the better, and the VUV emission intensity of 173 nm is three times the VUV emission intensity of 147 nm in Xe of 8% or more so that the loss at 147 nm in entire ultraviolet rays is significantly mitigated. Therefore, it is preferable that the Xe concentration is 8% or more.

Although the band gap of MgO is taken for example in the present embodiment, band gaps of most of crystals are in the region of vacuum ultraviolet rays, and, therefore, it is clear that it is effective even if the crystal is not the MgO crystal.

In the foregoing, the invention made by the inventors of the present invention has been concretely described based on the embodiments. However, it is needless to say that the present invention is not limited to the foregoing embodiments and various modifications and alterations can be made within the scope of the present invention.

For example, although the case of applying the present invention to a PDP of the surface discharge box type has been described in the above-described embodiments, the present invention can be also applied to PDPs of a surface discharge stripe type, an opposed discharge box type, and an opposed discharge stripe type.

The present invention is effective for an image display device, more particularly, an image display device performing light emission display by exciting a phosphor using vacuum ultraviolet rays caused by a discharge between electrodes. More particularly, the present invention can be widely used for the manufacturing industry of plasma display devices including a PDP.

What is claimed is:

1. A plasma display device comprising a plasma display panel, the plasma display panel including:

a first substrate having a plurality of first electrode pairs extending in a first direction;

a second substrate facing the first substrate and having a plurality of second electrodes extending in a second direction intersecting with the first direction; and a plurality of discharge cells provided on each position at which the plurality of first electrode pairs and the plurality of second electrodes intersect, wherein each of the plurality of discharge cells includes:

a discharge gap provided between the first substrate and the second substrate facing the first substrate and surrounded by a barrier rib on the second substrate;

a discharge gas containing Xe for filling the discharge gap; and a phosphor layer provided on the second substrate so as to be in contact with the discharge gap, the phosphor layer including a red phosphor material, a blue phosphor material or a green phosphor material, and wherein a firing voltage of a reset discharge of a discharge cell including a red phosphor material is uniform with a firing voltage of a reset discharge of a discharge cell including a blue phosphor material and is uniform with a firing voltage of a reset discharge of a discharge cell including a green phosphor material.

2. The plasma display device according to claim 1, wherein a crystal material having a different concentration is arranged in each of the phosphor layers including the red, blue and green phosphor materials, respectively, in order to make the firing voltages of the reset discharges of the plurality of discharge cells uniform.

3. The plasma display device according to claim 2, wherein the crystal material is at least disposed on a surface of the phosphor layer.

4. The plasma display device according to claim 2, wherein the crystal material is mixed with a material forming the phosphor layer.

5. The plasma display device according to claim 4, wherein the crystal material is set to 30% by weight or less of a weight ratio including the phosphor layer.

6. The plasma display device according to claim 2, wherein the crystal material is at least formed of any one of an alkaline metal oxide, an alkaline earth metal oxide, an alkaline metal fluoride, and an alkaline earth metal fluoride.

7. The plasma display device according to claim 6, wherein the crystal material is also formed of magnesium oxide.

8. The plasma display device according to claim 1, wherein a Xe concentration of the discharge gas is set to 8% or more.

9. A plasma display device comprising a plasma display panel, the plasma display panel including:

a first substrate having a plurality of first electrode pairs extending in a first direction;

a second substrate facing the first substrate and having a plurality of second electrodes extending in a second direction intersecting with the first direction; and a plurality of discharge cells provided on each position at which the plurality of first electrode pairs and the plurality of second electrodes intersect, wherein each of the plurality of discharge cells includes:

a discharge gap provided between the first substrate and the second substrate facing the first substrate and surrounded by a barrier rib on the second substrate;

a discharge gas containing Xe for filling the discharge gap; and a phosphor layer provided on the second substrate so as to be in contact with the discharge gap, the phosphor layer including a red phosphor material for emitting a red, a blue phosphor material for emitting a blue color or a green phosphor material for emitting a green color, wherein a first discharge cell includes a red phosphor material and a second discharge cell includes a blue phosphor material, and wherein a firing voltage of a reset discharge of the first discharge cell is uniform with a firing voltage of a reset discharge of the second discharge cell.

10. The plasma display device according to claim 9, wherein a third discharge cell includes a green phosphor material and a firing voltage of a reset discharge of the third discharge cell is uniform with the firing voltages of the reset discharges of the first and second discharge cells.

11. The plasma display device according to claim 10, wherein a crystal material having a different concentration is arranged in each of the red, blue and green phosphor materials, respectively, in order to make the firing voltages of the reset discharges caused in the plurality of discharge cells uniform.

12. The plasma display device according to claim 11, wherein the crystal material is at least disposede on a surface of the red, blue and green phosphor materials.

13. The plasma display device according to claim 11, wherein the crystal material is mixed with a material forming the red, blue and green phosphor materials.

14. The plasma display device according to claim 13, wherein the crystal material is set to 30% by weight or less of a weight ratio including the phosphor layer.

15. The plasma display device according to claim 11, wherein the crystal material is at least formed of any one of an alkaline metal oxide, an alkaline earth metal oxide, an alkaline metal fluoride, and an alkaline earth metal fluoride.

16. The plasma display device according to claim 15, wherein the crystal material is also formed of magnesium oxide.

17. The plasma display device according to claim 10, wherein a Xe concentration of the discharge gas is set to 8% or more.

* * * * *